United States Patent [19]

Bax

[11] Patent Number: 4,599,797

[45] Date of Patent: Jul. 15, 1986

[54] REVOLVABLE EATING UTENSIL AND METHOD OF CLEANING SAME

[76] Inventor: William P. Bax, 3044 Polly La., Flossmoor, Ill. 60422

[21] Appl. No.: 660,408

[22] Filed: Oct. 12, 1984

[51] Int. Cl.[4] ..... A47J 43/28

[52] U.S. Cl. ..... 30/323; 30/137

[58] Field of Search ..... 30/129, 137, 322, 323, 30/332–333

[56] References Cited

U.S. PATENT DOCUMENTS 1,418,189 5/1922 Kimball ..... 30/332

2,602,996 7/1932 Piche ..... 30/322

FOREIGN PATENT DOCUMENTS 367114 12/1921 Fed. Rep. of Germany ..... 30/322

*Primary Examiner*—Douglas D. Watts

*Attorney, Agent, or Firm*—Bernard L. Kleinke

[57] ABSTRACT

The revolvable eating utensil includes a handle portion in the form of an open frame, and an elongated member having a comestible engageable portion axially rotatably supported by the handle portion. The handle portion includes a pair of short front and rear walls joined by a pair of long side walls. The elongated member includes a rear shank poriton and extends through a pair of oppositely disposed bearings disposed in the front and rear walls. A device limits axial movement of the shank portion relative to said handle portion. The device can be removed from the shank portion, and the shank portion can then be slipped out of the handle portion. After cleaning, the unit is then quickly and easily re-assembled.

15 Claims, 4 Drawing Figures

REVOLVABLE EATING UTENSIL AND METHOD OF CLEANING SAME

DESCRIPTION

1. Technical Field

The present invention relates in general to an improved eating utensil and a method of cleaning it. The invention more particularly relates to an eating utensil which may be used to facilitate the consumption of comestibles, such as spaghetti, and which can be cleaned according to a novel method.

2. Background Art

There have been many types and kinds of eating utensils used to facilitate the consumption of difficult-to-eat comestibles, such as spaghetti. For example, reference may be made to the following U.S. Pat. Nos.: 2,748,479; 2,841,869; 3,552,017; 2,004,659; and 2,602,996.

As disclosed in the foregoing mentioned patents, various eating forks are revolvably mounted in their handles. In this manner, the user can grasp the handle and rotate the fork about its axis relative to the handle, to enable the spaghetti to be twirled about the fork in a relatively convenient manner.

While such utensils may have been satisfactory for some applications, it would be highly desirable to have a new and improved revolvable eating utensil, which is readily cleanable. The bearing surfaces have been difficult to clean after use, and thus restaurants and other eating establishments have been reluctant to provide such devices for use by their customers. Even though they may have been convenient to use, such devices could not be readily and thoroughly cleaned after repeated use, in commercial establishments, using conventional dishwashers. Inadequate cleaning could potentially create an unwanted health risk, due to the presence of undesirable bacteria.

Therefore, it would be highly desirable to have a new and improved revolvable eating utensil, which can be readily and conveniently cleaned after its use. Such an eating utensil should be convenient to use, and relatively inexpensive to manufacture.

DISCLOSURE OF INVENTION

Therefore, the principal object of the present invention is to provide a new and improved revolvable eating utensil and a method of cleaning it, wherein the utensil is readily and conveniently cleanable, and is relatively inexpensive to manufacture.

Briefly, the above and further objects of the present invention are realized by providing a new and improved revolvable eating utensil, which can be cleaned in a convenient and thorough manner according to a novel cleaning method of the present invention.

The revolvable eating utensil includes a handle portion in the form of an open frame, and an elongated member having a comestible engageable portion axially rotatably supported by the handle portion. The handle portion includes a pair of short front and rear walls joined by a pair of long side walls. The elongated member includes a rear shank portion and extends through a pair of oppositely disposed bearings disposed in the front and rear walls. A device limits axial movement of the shank portion relative to said handle portion. The device can be removed from the shank portion, and the shank portion can then be slipped out of the handle portion. After cleaning, the unit is then quickly and easily re-assembled.

The open frame construction of the handle portion facilitates the cleaning of the utensil. Substantially the entire length of the shank portion is exposed for cleaning purposes. Additionally, there are only two discrete bearing surfaces which are exposed to cleaning action, such as the cleaning action of a dishwasher.

For an even more thorough and meticulous cleaning procedure, the utensil can be readily disassembled, cleaned and then re-assembled according to the novel method of the present invention.

BRIEF DESCRIPTION OF DRAWINGS

The above-mentioned and other objects and features of this invention and the manner of attaining them will become apparent, and the invention itself will be best understood by reference to the following description of an embodiment of the invention taken in conjunction with the accompanying drawings, wherein.

BEST MODE FOR CARRYING OUT THE INVENTION

Figure 1:
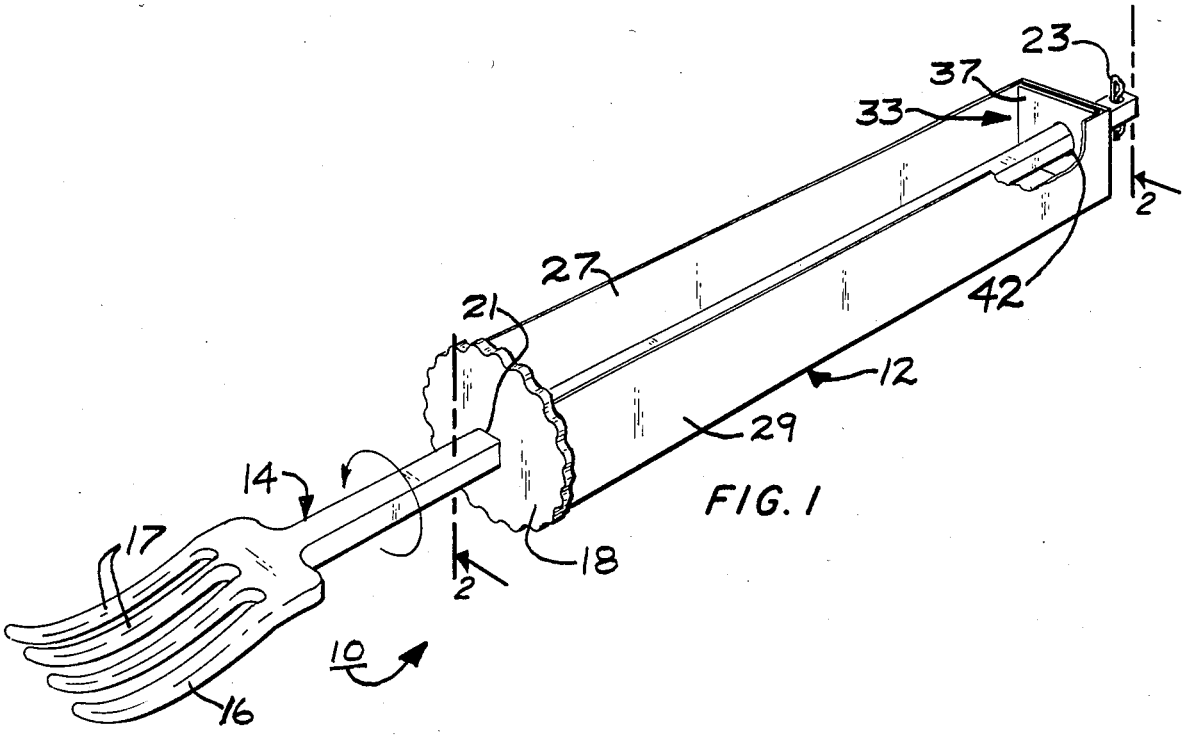
FIG. 1 is a perspective view of revolvable eating utensil, which is constructed in accordance with the present invention.
Figure 2:
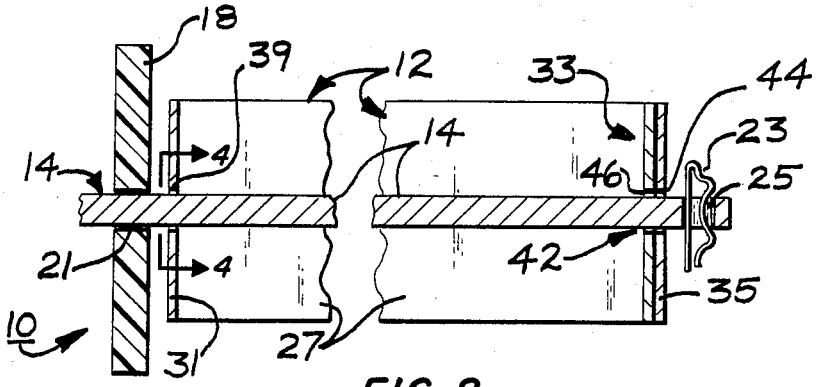
FIG. 2 is an enlarged sectional elevational view of the utensil of FIG. 1, taken substantially on line 2—2 thereof.
Figure 4:
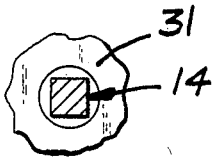
FIG. 4 is a sectional view of the utensil of FIG. 2 taken substantially on line 4—4 thereof.
Figure 3:
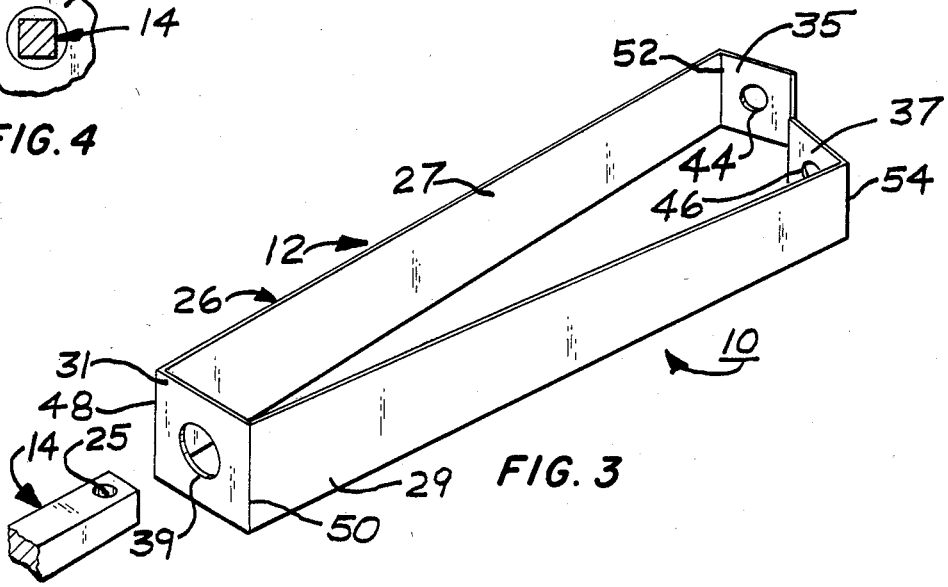
FIG. 3 is a perspective, fragmentary view of the utensil of FIG. 1, illustrating it disassembled for cleaning purposes.

Referring now to the drawings, and more particularly to FIGS. 1 and 2 thereof, there is shown an eating utensil 10, which is constructed in accordance with the present invention. The utensil 10 can be readily cleaned in accordance with the method of the present invention.

The utensil 10 generally comprises a handle portion 12, having an elongated axially-extending rigid member 14. The member 14 includes an enlarged comestible engaging fork portion 16, having tines 17 at the front end thereof. The member 14 is axially rotatably mounted in the handle portion 12 to facilitate the eating of a comestible, such as spaghetti (not shown).

A thumb wheel 18, fixed to the member 14, has a thumb engageable irregular edge, and thus enables a user to hold the utensil 10 by the handle portion 12 and rotate the member 14 relative to the handle portion 12. The user manipulates the thumb wheel 18 with the user's thumb of the same hand that holds the handle portion 12. In this manner, the utensil 10 can be held and operated in one hand.

In use, the utensil 10 is grasped and held in the hand in a manner similar to a conventional eating utensil. When eating spaghetti, the fork portion 16 lifts several spaghetti strands; and the user's thumb then rotates the wheel 18 to cause the rigid member 14, and thus the fork portion 16, to revolve about its longitudinal axis relative to the handle portion 12.

In this manner, the spaghetti strands become readily wrapped or twirled about the fork portion 16, to facilitate the lifting of them to the user's mouth. This action can be repeated in an easy manner.

Considering now the construction of the utensil 10 in greater detail, the rigid member 14 extends through a complementary shaped hole or opening 21 centrally disposed in the thumbwheel 14 in a press fit manner to fix the wheel 18 to the member 18. In this regard, the thumbwheel is fixedly mounted toward the forward end of the rigid member 18 behind the fork portion 16. The rigid member 14 is square in cross section throughout the rear portion thereof and is slightly tapered from end to end, to cause it to be fixedly pressed fitted within the square hole or opening 21.

In order to limit axial movement of the member 14 relative to the handle portion 12, a clip or pin 23 extends into and through a cross-hole 25 in the rear end portion of the member 14. The clip 23 is U-shaped and snaps into the hole 25, and is thus releasably secured in place. As hereinafter described in greater detail, the clip 23 can be slipped out of the hole 25 by applying pressure to it and causing it to deform inwardly, so that it can be readily withdrawn from the hole 25. After assembly, the clip 23 is deformed inwardly and then slipped into the hole 25, where it expands outwardly to retain its position therewithin. In this manner, the clip 23 extends above and below the member 14 to serve as an abutment means to limit axial movement of the member 14.

Considering now the handle portion 12 in greater detail, the handle portion 12 is in the form of an open frame construction to allow the various parts thereof to be exposed to a cleansing action. The central member 14 is disposed within of open construction for cleaning purposes. In this regard, it should be noted that the front and rear bearing openings are readily cleanable, since they are exposed to a cleaning action.

Also, the square cross-sectional shape of the member 14 allows spaces within the circular bearing opening to permit the ready dislodgement of food particles therefrom during a cleaning operation. Thus, an unwanted build up of food particles in the bearing areas is thereby prevented, or at least the possibility thereof is greatly reduced.

The handle portion 12 includes a metal strip 26 folded into an open frame. The metal strip 26 is preferrably composed of a stainless steel material, which can be readily cleaned.

The handle portion 12 includes a pair of parallel spaced-apart long walls 27 and 29. A short front wall 30 and a short rear double wall 33 complete the open frame construction. The rear double wall 33 comprises a pair of overlapping tab portions 35 and 37.

A front bearing opening 39 is in the form of a circular, centrally-disposed hole 39 extending through the front wall 31. A rear bearing opening generally indicated at 42, extends through the rear double wall 33, and comprises a pair of rear circular bearing openings 42 and 44 in the respective tab portions 35 and 37. The bearing openings are axially aligned with one another, to receive and to rotatably support the rigid member 14.

In order to assemble the handle portion 12, the long side walls 27 and 29 fold about the respective fold lines 48 and 50 extending between the respective walls 27 and 29, and the front wall 31, to assume a rectangular configuration. The tabs 35 and 37 overlap one another at the rear end of the handle portion 12. The tabs 35 and 37 are positioned with their holes 44 and 46 in axial alignment with one another.

For the purpose of completing the assembly of the handle portion 12, the rigid member 14 is manually slipped through the front bearing opening 39, and then rearwardly through the bearing openings 44 and 46. Once the rear end portion of the member 14 projects rearwardly from the rear bearing opening 42, the clip 23 is slipped through the hole 25 to retain the member 14 in position. Thereafter, the member 14 can rotate within the bearing openings.

For facilitating an even more thorough and complete cleaning of the utensil 10, the clip 23 is removed from the hole 25, and the member 14 is pulled forwardly to slip it out of the bearing openings to free it from the folded strip 26. In this manner, each one of the portions of the utensil 10 can be readily and thoroughly cleaned, such as a cleaning in a dishwasher (not shown).

To facilitate greatly the cleaning of the handle portion 12, the disassembled strip 26 can be unfolded into a flat position, so that all corners have been removed temporarily to permit the complete cleaning thereof. Thus, little or no unwanted build up of bacteria producing food particles is experienced.

After cleaning the utensil 10 in its disassembled form, the utensil 10 can be readily reassembled as hereinbefore described.

While a particular embodiment of the present invention has been disclosed, it is to be understood that various different modifications are possible and are contemplated within the true spirit and scope of the appended claims.

For example, different types of materials may be employed, and such materials may include plastic and/or wood. Also, instead of a fork portion, a spoon portion may be employed.

There is no intention, therefore, of limitations to the exact abstract or disclosure herein presented.

I claim:

1. An eating utensil for use with comestibles comprising:

an elongated rigid member having an enlarged comestible engageable portion at the front end thereof and having a rear shank portion;

a handle portion for rotatably supporting said rear shank portion, the handle portion being an open frame, said frame being generally rectangular in shape and having four walls, said walls including a pair of oppositely-disposed parallel spaced-apart front and rear short end walls at respective ones of a front end and a rear end of the handle, and a pair of oppositely-disposed parallel spaced-apart long side walls;

a pair of oppositely-disposed front and rear bearing means disposed in the respective front and rear walls for axially rotatably supporting said shank portion for enabling said rigid member to revolve about its axis relative to said handle portion, each one of said front and rear bearing means including means defining a bearing opening extending through the respective end walls, the rear shank portion extending through said bearing openings and rearwardly beyond the rear end of the handle portion;

a thumb wheel attached to the rear shank portion to enable a user to rotate the elongated rigid member relative to the handle portion, including means for attaching the thumb wheel to the rear shank portion forwardly of the handle portion, said thumb wheel being substantially larger transverse dimension than the distance between the side walls of the handle portion to facilitate manipulation by the hand of the user while grasping the handle portion; and means for limiting axial movement of said shank portion relative to said handle portion, said means including a member removably attached to a rear distal end portion of the rear shank portion extending rearwardly beyond the rear end of the handle portion so that said member can be removed from said rear shank portion to permit the rear shank portion to be slipped out of the handle portion for cleaning purposes;

wherein the rear shank portion of the elongated rigid member has a length sufficient to extend through both bearing openings, and a distal end portion extending rearwardly beyond the rear bearing opening; and wherein said rear shank portion has a cross-section with a first shape and each of the bearing openings has a second shape, one of said first and second shapes being generally circular and the other one of said first and second shapes being generally polygonal.

2. An eating utensil according to claim 1, wherein said means for limiting axial movement is removeably attached to said shank portion disposed to the rear of said handle portion so that when the limiting means is detached from said shank portion, said member can be slipped out of said handle portion and separated therefrom for cleaning purposes, by pulling on said member in an axial forward direction.

3. An eating utensil according to claim 2, wherein said limiting means includes means defining an opening in the rear end portion of said shank portion, and moveable means extending into said opening.

4. An eating utensil according to claim 3, wherein said moveable means includes a retaining clip.

5. An eating utensil according to claim 1, wherein said handle portion includes a one-piece strip folded into a generally rectangular configuration.

6. An eating utensil according to claim 5, wherein said strip includes a pair of overlapping integral portions to form one of said front and rear walls.

7. An eating utensil according to claim 6, wherein said front and rear bearing means each include means defining an opening extending through its end wall.

8. An eating utensil according to claim 7, wherein said means for limiting axial movement is removeably attached to said shank portion disposed to the rear of said handle portion so that when the limiting means is detached from said shank portion, said member can be slipped out of said handle portion and separated therefrom for cleaning purposes, by pulling on said member in an axial forward direction.

9. An eating utensil according to claim 8, wherein said limiting means includes means defining an opening in the rear end portion of said shank portion, and moveable means extending into said opening.

10. An eating utensil according to claim 9, wherein said moveable means includes a retaining clip.

11. An eating utensil according to claim 1, wherein said handle portion includes a one-piece strip folded into a generally rectangular configuration.

12. An eating utensil according to claim 11, wherein said strip includes a pair of end tabs arranged to overlap to form one of said end walls.

13. An eating utensil according to claim 12, wherein said strip is composed of stainless steel.

14. The device of claim 1, wherein the shank portion is rectangularly shaped and the bearing openings are circularly shaped.

15. The device of claim 1, wherein said thumb wheel is centrally apertured, and the rear shank portion decreases in cross sectional area in a tapered manner toward the distal end to enable the thumb wheel to be press fitted on the shank portion for assembly purposes, and manually removed from the shank by sliding it off the distal end for disassembly and cleaning purposes.

* * * * *